US005128028A

United States Patent [19]

Lamort

[11] Patent Number: 5,128,028

[45] Date of Patent: Jul. 7, 1992

[54] SIEVE FOR PAPER PULP STRAINER AND CLASSIFIER

[75] Inventor: Jean-Pierre Lamort, Vitry, France

[73] Assignee: E & M Lamort, Vitry, France

[21] Appl. No.: 689,714

[22] Filed: Apr. 22, 1991

Related U.S. Application Data

[63] Continuation of Ser. No. 392,852, Aug. 11, 1989, abandoned.

[30] Foreign Application Priority Data

Aug. 12, 1988 [FR] France ..... 88 10863
Mar. 15, 1989 [FR] France ..... 89 03379

[51] Int. Cl.[5] ..... B07B 1/46; D21D 5/00

[52] U.S. Cl. ..... 209/397; 29/163.7; 29/163.8; 209/273; 210/497.1; 210/485

[58] Field of Search ..... 209/270, 273, 393, 397, 209/399, 395, 300, 305; 210/484, 485, 497.1, 491.01, 499, 498; 29/163.6-163.8

[56] References Cited

U.S. PATENT DOCUMENTS

| | | | |
|---|---|---|---|
| 1,800,642 | 4/1931 | Johnson | 29/163.7 X |
| 1,930,128 | 10/1933 | Lund | 210/497.01 X |
| 2,015,139 | 9/1935 | Dustan | 209/397 |
| 2,423,442 | 7/1947 | Dustan | 209/270 |
| 2,519,162 | 8/1950 | Tucker | 209/399 X |
| 3,101,526 | 8/1963 | Paullus et al. | 29/163.7 X |
| 3,617,008 | 11/1971 | Lamort | 209/393 |
| 4,265,742 | 5/1981 | Bucker | 209/399 |
| 4,406,326 | 9/1983 | Wagner | 29/163.7 X |

FOREIGN PATENT DOCUMENTS

| | | | |
|---|---|---|---|
| 110081 | 8/1899 | Denmark . | |
| 248122 | 4/1911 | Fed. Rep. of Germany | 209/397 |
| 609741 | 10/1932 | Fed. Rep. of Germany | 209/393 |
| 1178881 | 5/1959 | France | 209/397 |
| 1539846 | 7/1968 | France . | |
| 2384888 | 7/1983 | France . | |
| 2539644 | 5/1985 | France . | |
| 2572950 | 1/1987 | France . | |
| 289915 | 12/1986 | Japan | 29/163.6 |
| 7211272 | 8/1972 | Sweden . | |
| 5995 | of 1892 | United Kingdom | 209/397 |
| 519680 | 4/1940 | United Kingdom . | |
| 2195911 | 4/1988 | United Kingdom . | |

OTHER PUBLICATIONS

French Patent Application entitled "Perfectionment Aux Tamis Pour Epurateurs De Pate A Papier" (No. 7211272-5), no date.

*Primary Examiner*—Donald T. Hajec
*Attorney, Agent, or Firm*—Darby & Darby

[57] ABSTRACT

Sieve for paper pulp strainer and classifier of the kind formed by the juxtaposition of elements of U-shaped cross section comprising a perforated flat bottom (2) and two sidewalls (3) characterized in that the elements (1) of U-shaped cross section are disposed so as to form a notable cylindrical revolving wall, provided with slots or holes, whether or not associated with grooves and bars (obstacles).

20 Claims, 4 Drawing Sheets

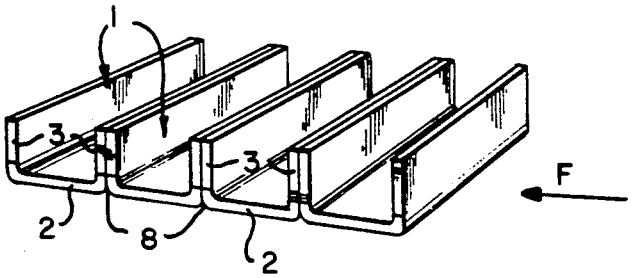
FIG. 1
FIG. 2
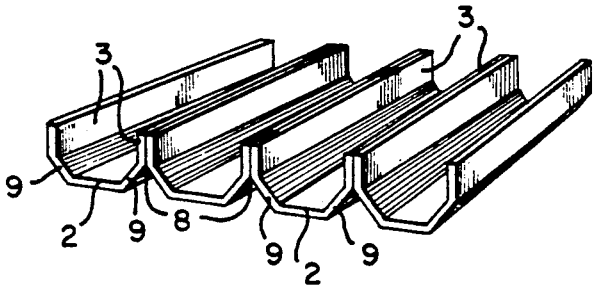
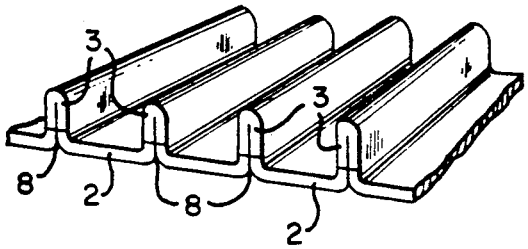
FIG. 3
FIG. 4
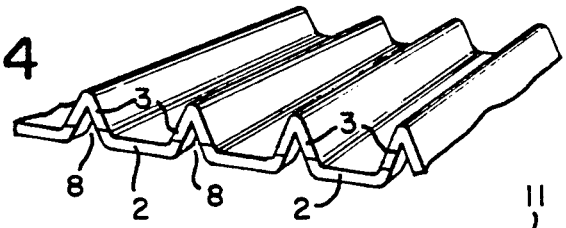
FIG. 5
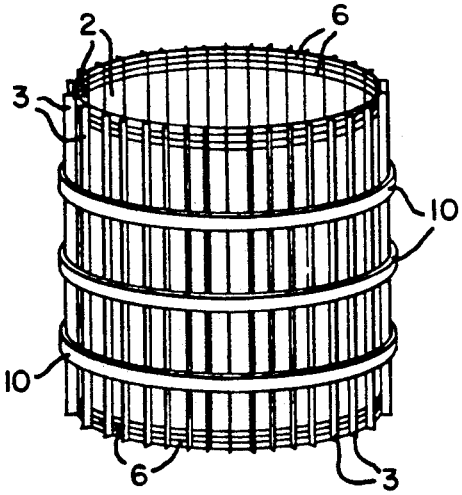
FIG. 6
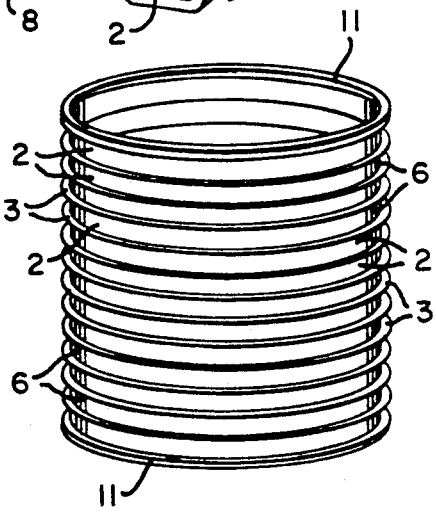

FIG. 7a
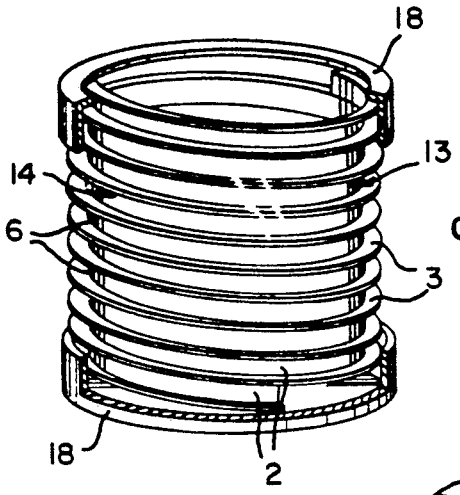
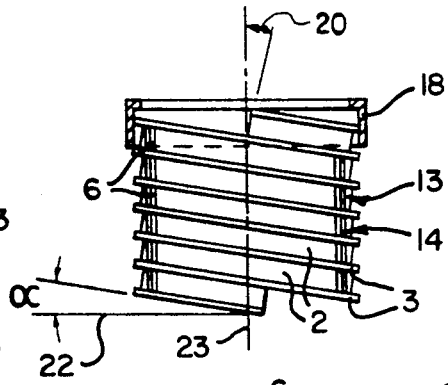
FIG. 8
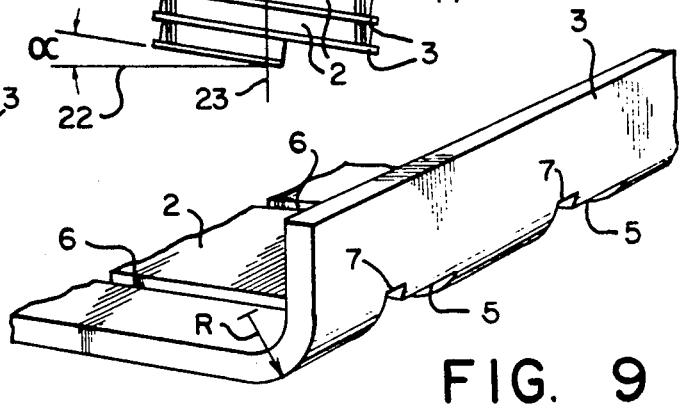
FIG. 9
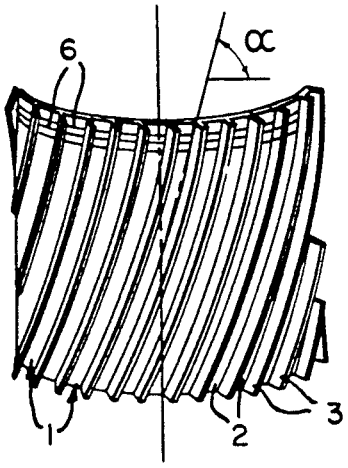
FIG. 7b
FIG. 10
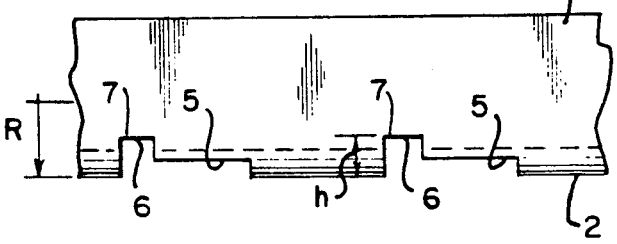
FIG. 12
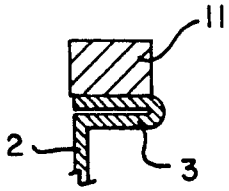
FIG. 11
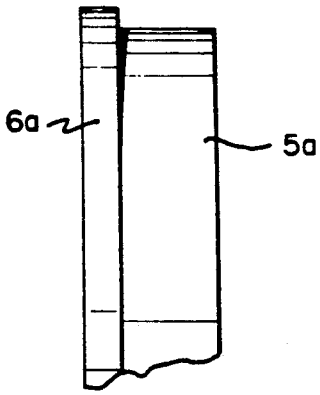
FIG. 14
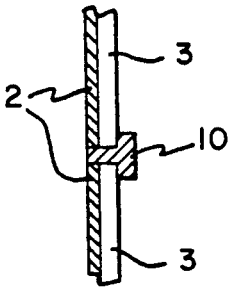
FIG. 13
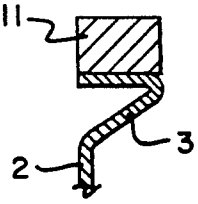

FIG. 15
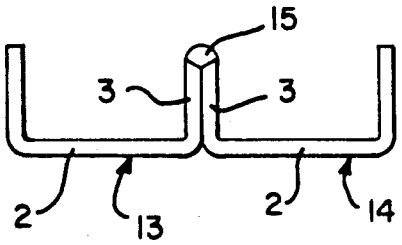
FIG. 16
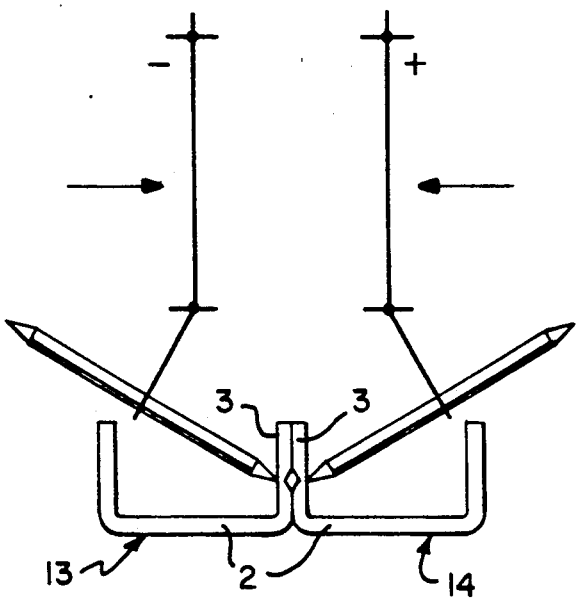
FIG. 17
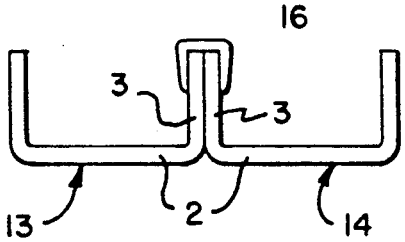
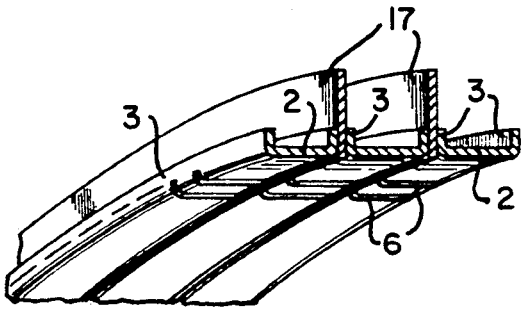
FIG. 18
FIG. 19
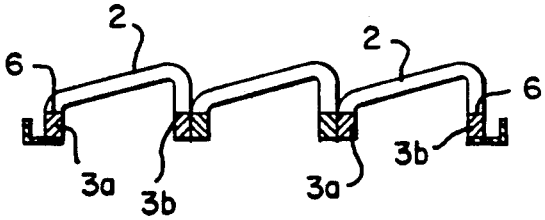
FIG. 20
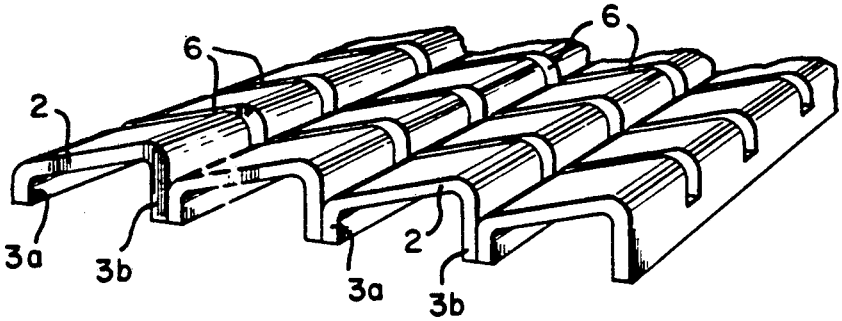

FIG. 21
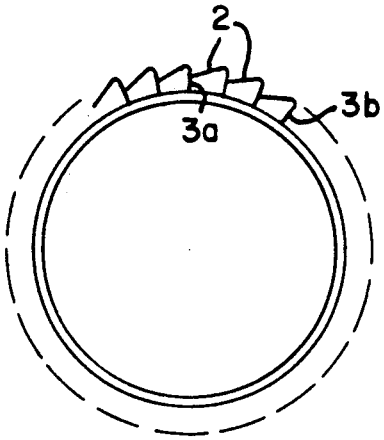
FIG. 22
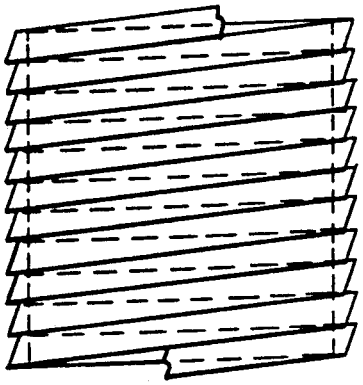
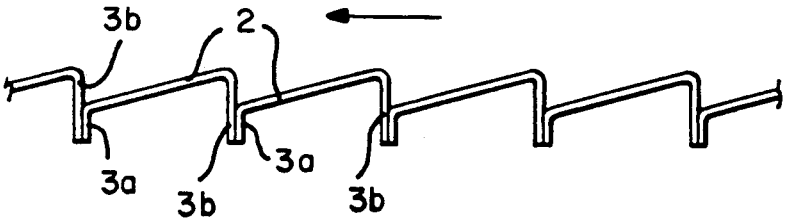
FIG. 23
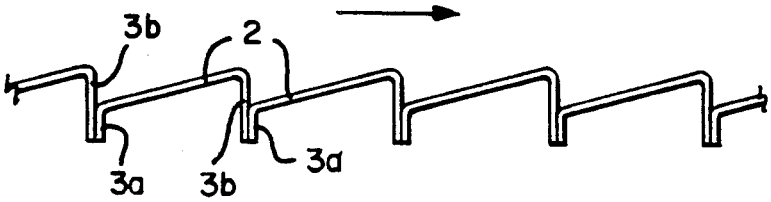
FIG. 24
FIG. 25
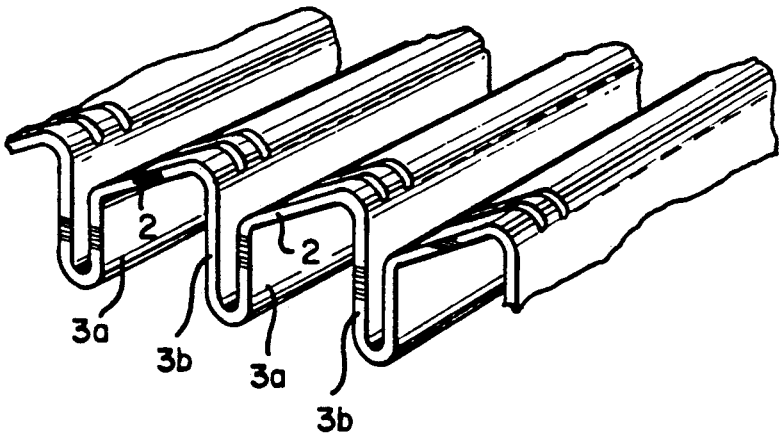
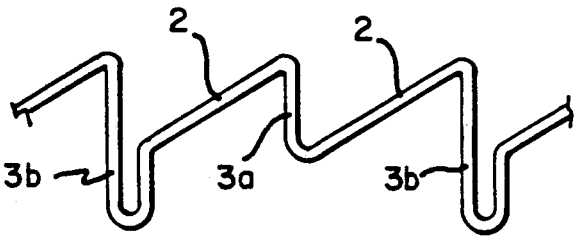
FIG. 26

SIEVE FOR PAPER PULP STRAINER AND CLASSIFIER

This is a continuation of application Ser. No. 07/392,852, filed Aug. 11, 1989 now abandoned

BACKGROUND OF THE INVENTION

In the paper pulp industry, and more particularly in the industry of production of paper pulp from used paper, a large number of sieves is used both for separating the fibers forming the paper pulp from the various impurities (called "contaminants") occurring in used paper, in equipment called "strainers", as well as for sorting the fibers according to their length in equipment called "classifiers".

It is known how to make such sieves by providing them with holes or slots, and it is also known from numerous patents such as FR 1,539,846; U. S. Pat. No. 3,617,008; SE 72/11272; FR 78 08132 and FR 88 10684 how to arrange, upstream of the slots or holes made through the wall of the sieve, bar ("obstacles") followed by grooves which, in cooperation with a hydrodynamic fan, cause pulsations which improve the efficiency of the sieve and prevent it from becoming clogged.

But these sieves, whether they have holes or slots and whether or not they are provided with bars (obstacles), have until now been made by machining solid plates, with great difficulty.

In fact, the slots and holes must, for reasons of loss of charge and fouling, be very short, that is, of the order of 0.5 to 1 mm; the plates used in modern technology, however, are must thicker, of the order of 8 to 10 mm, for reasons of strength, and as the performances demanded by the users keep increasing, the thicknesses of the plates increase. As a result, it is necessary to machine a clearance in the thickness of the plate and then to clean and polishthis clearance, these two operations representing the most important work that is carried out on the plates.

SUMMARY OF THE INVENTION

It is the object of the present invention to permit making high performance sieves using stainless steel sheets which are relatively thin, of the order of 2 millimeters.

The techology of the present invention, which permits using such thin plates while yet obtaining the necessary strength, allows doing away with the clearances that ar indispensable on the thick plates and greatly reduces the work of machining, cleaning and polishing. Besides, less raw material is consumed.

This technology is based on the use of sectional element of U-shaped cross-section. It is known from U. S. Pat. No. 2,015,139 how to make sieves by means of U-shaped sections. This patent describes a flat tray made up of U-shaped sectional elements each having a bottom and two lateral walls. The elements are juxtaposed and kept in position by welding two adjacent walls. The tray is machined so as to make a succession of slots. But this machining also cuts out the lateral wall and it is necessary to provide stiffeneing bars to preserve the flatness of the tray.

The object of the present invention is a sieve for paper pulp strainers and classifiers of the kind consisting of the juxtaposition of element of U-shaped cross section comprising a flat bottom provided with perforations and two lateral walls, characterized in that the elements of U-shaped cross section are arranged so that they form a cylindrical wall, with slots or holes whether or not associated with grooves and bars (obstacles).

The elements are disposed either parallel or perpendicular to the generatrices of the cylinder or forming an angle of between 0° and 90° with the direction of the generatrix of the cylinder.

When the elements are parallel to the generatrices, they are straight and placed side by side: when they are perpendicular to said generatrices, they are arched so as to be circular; when they are inclined relative to the generatrices, they are spirally wound.

In this latter variant, the sieve has at least one element of U-shaped cross section. When the angle formed between the plane perpendicular to the longitudinal axis of the sieve and the longitudinal axis of the element is close to 90°, the sieve comprises a plurality of inclined elements disposed in a spiral.

When the inclination alpha decreases, the sieve may be made of only one spirally wound element, the spirals being contiguous.

The element of U-shaped cross section may be made by bending the sheetmetal or they may consist of U-shaped sections which are joined side by side and held in place by any means.

In addition, to increase the rigidity of the cylinder, the sieve comprises a flat element between two adjacent walls of two succesive elements.

Further, according to a variant of realization of the invention, the sieve can be made by using U-shaped sections, the flanges of which are of unequal length, but the ends of said flanges are in the same plane which is perpendicular to them so that the bottom of the U where the holes or slots are cut is inclined; thus the perforated surface is inclined relative to the cylindrical surface of the sieve.

If the U's of asymmetrical cross-section are disposed along the generatrices of the cylindrical sieve, "obstacles" are formed which, depending on the direction of displacement of the liquid, either decelerate it or cause the effect known as pulsation and/or whirling described in the above cited patents.

If the asymmetrical U's are wound along a helix, one obtains a helicoidal furrow guiding the rejects (materials stopped by the sieve) toward their evacuation zone.

The asymmetrical U's may be obtained by folding a plate or by juxtaposition of separate element as with the symmetrical U's.

BRIEF DESCRIPTION OF THE DRAWINGS

By way of non-limited examples there are shown in the annexed drawings:

FIG. 1—a schematic view in perspective illustrating a portion of sieve made by arranging U-shaped sections side by side;

FIG. 2—a schematic view of a variant of realization of FIG. 1;

FIG. 3—a schematic view in perspective illustrating a portion of sieve made by bending sheetmetal;

FIG. 4—a schematic view of a variant of realization of FIG. 3;

FIG. 5—a schematic view illustrating a cylindrical sieve according to the invention in which the U-shaped elements are straight and parallel to the generatrices of the cylinder;

FIG. 6—a schematic view illustrating a cylindrical sieve according to the invention in which the U-shaped elements are circular and perpendicular to the generatrices of the cylinder;

FIG. 7*a* and 7*b*—two schematic views illustrating a cylindrical sieve according to the invention in which the juxtaposed U-shaped element are arranged in a spiral;

FIG. 8—a side view of the sieve of FIG. 7;

FIG. 9—a large scale detail view in perspective illustrating the arrangement of the grooves and slots;

FIG. 10—a view in side elevation of FIG. 9;

FIG. 11—a schematic view of a milling cutter making the groove and the slot simultaneously;

FIG. 12 and 13—two detail views concerning a sieve according to FIG. 6;

FIG. 14—a detail view corresponding to the sieve of FIG. 5;

FIG. 15, 16, 17—three variants of realization of the joining of the section;

FIG. 18—a schematic view of a variant of realization of the sieve.

FIG. 19—a schematic detail view illustrating the juxtaposition of asymmetrical sections of U-shaped cross-section;

FIG. 20—a view in perspective of FIG. 19;

FIG. 21—a schematicview illustrating a cylindrical sieve made by means of asymmetrical U-shaped sections placed parallel to the generatrix of the cylinder;

FIG. 22—a schematic view illustrating a cylindrical sieve made by means of a single asymmetrical U-shaped sections wound in a spiral;

FIG. 23 and 24—two views illustrating the movement of the liquid relative to the sieve of FIG. 20;

FIG. 25—a partial view in perspective representing a portion of sieve wall obtained by folding, to make asymmetrical U's;

FIG. 26—a sectional view of a variant of FIG. 25.

DESCRIPTION OF THE PREFERRED EMBODIMENTS

Referring to these figures it is seen that according to the invention a sieve is made from a plate of small thickness, between 1.5 and 2.5 mm, by juxtaposing elements 1 whose cross section is U-shaped.

In FIGS. 1 and 2 it is seen that the sieve consists of U-shaped sections 1, which are placed alongside each other. Each element 1 has a bottom 2 and two sidewalls 3; the element 1 adjoin by their sidewalls 3, the bottoms 2 forming the cylindrical surface of the sieve in which the holes, slots and/or grooves will be made.

In FIGS. 3 and 4 it is seen that the elements are made by making folds on a sheetmetal plate, so as to obtain also sidewalls 3 and a bottom 2.

In said U-shaped elements, grooves 5 and slots 6 perpendicular to the longitudinal axis of said elements, or perpendicular to the sidewalls 3, can then be made (FIGS. 3 and 10).

Thus the grooves 5 are made in the bottom 2, from the outer side opposite the ends of the lateral walls, perpendicular to their longitudinal axis but to a depth smaller than the thickness of said bottom 2, and then a slot 6 is made in the bottom of groove 5 to a depth greater than that of the thickness of the bottom 2 so as to traverse it. Preferably a milling cutter consisting of two adjoining disks is used (FIG. 11), one, 5*a*, to make the groove 5 and other, 6*a*, of large diameter, to make the slot 6. Thus one obtains in a single operation a slot 6 which is very exactly positioned relative to the groove, which is very imporatant.

As is seen in FIGS. 1 to 4, the U-shaped elements are designed so that at the bottom of the junction of two vertical walls 3 there is still a space 8 such that each groove 5 and slot 6 opens freely into two empty spaces 8 by their two ends.

In the case of FIGS. 1 and 3, this requires that the radius of curvature R (FIGS. 9 and 10) of the surface making the junction between the bottom 2 and the sidewalls 3 be greater than the height "h" of the notch formed in wall 3 to pierce the bottom 2 when the slot 6 is being made.

The same result can be obtained by connecting the walls 2 and 3 by oblique walls 9 as shown in FIG. 2 or by not forming the folds of the sheetmetal as is represented in FIG. 4.

The advantage of this arrangement is that the slots 6 have no end walls and that thus they do not touch, either during machining or during use of the sieve by a heaping up of fibers.

Thus there is obtained not only a very easy and very precise machining but also a sieve which does not clog, and this with a thinner and hence less expensive plat.

In a first form of realization, the U-shaped elements may be straight and parallel to the generatrices of the cylinder as shown in FIG. 5 or they may be circular and perpendicular of these generatrices as shown in FIG. 6.

In the case of FIG. 5, it turns out that the U-shaped elements must not have too great a length, as they would otherwise tend of flex. Therefore one uses elements of short length so as to make a succession of small cylinders which are assembled on one another by circular rims 10, as shown in FIG. 14.

In the case of FIG. 6, the folding of the sheetmetal is done flat, and once the fins corresponding to the walls 3 are made, the sheet is arched. It is practically impossible to obtain a regular arching of a stainless steel sheet having fins. However, it has been found that if after the creation of the folds and before arching one proceeds to machine the holes, slots and possibly the grooves intended to form the bar (obstacles) combined with the perforations (holes or slots), said arching occurs very easily and very regularly, owing to the presence of the slots 6 and grooves 5. Then a fastening rim 11 which is fastened either to a closed fold as shown in FIG. 12 or to an open fold as shown in FIG. 13 is disposed at the bottom portion as well as at the top portion of the cylinder. In either case the presence of this fold give great elasticity to the assembly.

In a second form of realization (FIGS. 7*a*, 7*b* and 8), a cylinder sieve is made by spiral winding of one or more elements of U-shaped section previously machined, that is, having the perforations 6 (slots or holes) and possibly the grooves 5 described above. The U-shaped element 1 is formed into at least one continuous loop joined together at the side walls 3 to form a cylinder. The side walls 3 of the loop extend continuously and unobstructed for 360 degrees.

The sieve may be made with a single element 1 of great length, made either in one piece, or by butt-welding a plurality of identical elements (FIG. 7*a*).

Preferably the winding up is done by fastening one of the ends of the element on a mandrel which, when rotated, does the arching and the spiral winding. In that case, the turns have a small inclination alpha of a few degrees relative to the plane perpendicular to the axis of the cylinder.

The example of realization illustrates a cylindrical sieve, but the invention is not limited to this shape and extends to any forms of revolution, conical, cylindro-conical, etc.

When the spiral winding of element 1 is completed, the spirals 13, 14 are secured together so that they are strictly contiguous, to prevent an outflow of pulp betwen two spirals.

In the stage of perforation of the elements, the grooves and-or slots may be made, not perpendicular to the longitudinal axis of the element, or to the sidewalls, but in a direction 20 inclined by an angle alpha relative to the perpendicular 19 to the axis, this angle being equal to the inclination of the spirals of the sieve relative to plane 22 perpendicular to the longitudinal axis 23 of the sieve. This preliminary inclination alpha of the slots permits obtaining slots parallel to the axis of revolution of the sieve.

According to another form of realization, it is possible to make a sieve by juxtaposing U-shaped elements, these elements being inclined and spirally wound as illustrated in FIG. 7*b*. In this case, the angle of inclination alpha of the elements with the plane perpendicular to the longitudinal axis of the cylinder is close to 90°.

Lastly, the realization of the sieve is achieved by setting in place, at each end, an end rim 18 which engages on the last spirals and which defines a surface perpendicular to the axis of revolution of the sieve, as FIGS. 7*a* and 8 show. These rims are intended to permit installing the sieve in the body of the strainer or classifier.

THe assembly of the juxtaposed elements can be realized according to several variants regardless of the form of realization of the sieve (straight elements, FIG. 5, annular FIG. 6, or in a spiral, FIG. 7).

In a first variant (FIGS. 15, 16) , assembling is done either by classic welding of the ends of the two adjacent sidewalls 3, with build-up of metal 15, or by continuous electric welding of the adjacent flanges.

In a second variant (FIG. 17), assembling is carried out by setting in place a section 16, or rider, also of a general inverted U-shaped cross-sectional form, which caps and squeezes two adjacent flanges.

The rider is continuous and, depending on the form of realization, it is either straight and holds in place two adjacent walls over the entire length of the cylinder or between two rims 10, or annular in the case of circular elements (FIG.6), or spirally wound between two contiguous spirals 13, 14 along the enitre helix.

A third variant of realization is shown in FIG. 18. In this variant, the sections are made with a band iron of small thickness, of the order of 0.5 to 1 millilmeter, the transverse dimensions of the section being of the order of one centimeter, for example with flanges of 10 millimeters and a base of 20 millimeters; however, a sieve made with such a band is rather fragile. To stiffen it, it is provided to insert between two adjacent flanges a flat metallic elemment 17. This flat element is bent so that its edge is curved to the sieves cylindrical shape and held in contact between the walls 3 by electric welding, preferably by continuous welding. This flat element 17 is approximately of the same thickness as the band iron, and its width is at least equal to the height of the flanges. Preferably the flat element exceeds the flanges by two or three times their height.

This variant of realization offers an important advantage: with U-shaped elements of small dimensions and small thickness, very small perforations (slots or holes) can be made. Slots of a width ranging from one millimeter to some ten microns can be obtained.

With such orders of magnitude, the deformation of the material during the arching of the element is of great importance for the final cross section of the perforations: the metal on the concave side is compressed and the perforation closes up again, while on the opposite convex side it is stretched and the perforation opens. For slotted sieves perforations are then obtained whose transverse form is V-shaped, which helps in the operation of the sieve.

The sieve according to the invention offers great technical and economical advantages. Technically its realization is simple and can be automated in large part. The use of thin metal sheet results in reduced machining, hence reduced loss of metal, but at the same time very fine perforations can be made with precision and by means of conventional tools. Economically such sieves are less costly in material, but above all much faster to produce; hence their cost of construction is clearly reduced.

FIGS. 19 to 24 relate to another variant of realization according to which the sections of U-shaped cross-section are no longer symmetrical as was the case in the preceding figures, but asymmetrical.

By asymmetrical U-shaped sections is understood that the botom 2 of the U, on which the perforations (holes or slots) and possible the grooves associated therewith to form the bars (obstacles) are cut, is inclined obliquely relative to the flanges (instead of being perpendicular to them) and that said flanges 3*a* and 3*b* have unequal lengths so that their ends are in the same plane that is perpendicular to them. As a result, the surface of bottom 2 of said sections in which the perforations (holes or slots) and possibly the grooves 5 are cut is inclined relative to the cylindrical surface of the sieve.

These asymmetrical U-shaped sections are made use of in exactly the same manner as the symmetrical U-shaped sections described above. Thus one can either juxtapose them parallel to the generatrices of the cylinder as represented in FIG. 21 or wind them in a spiral as represented in FIG. 22.

It will be noted that in the case of FIG. 21 one obtains bars (obstacles) which, depending on the direction of the displacement of the liquid, either decelerate it (FIG. 23) or produce the effect known as pulsation and/or whirling (FIG.24).

Everything that was described before in connection with symmetrical U-shaped elements is applicable to the asymmetrical U-shaped elements. In particular a sieve can be made by folding to make asymmetrical U's as shown in FIG. 25. Comparing FIGS. 25 and 26 it is seen that there can be a sheetmetal fold at each asymetrical U-shaped element, as represented in FIG. 25, or a sheetmetal fold between several asymmetrical U-shaped elements (FIG. 26).

I claim:

1. A sieve for a paper pulp strainer and classifier comprising:

at least one elongated element having a U-shaped cross section, said at least one U-shaped element having a bottom including openings therein and two side walls, said at least one element being formed into a least one continuous loop joined together at said sidwalls to form a cylinder, said cylinder having a cylindrical wall substantially comprising said at least one bottom and including and openings, said side walls of said at least one loop extending continuously for 360 degrees, said U-shape being unobstructed for 360 degrees of said at least one loop.

2. A sieve according to claim 1, wherein the cross section of the at least one element is symmetrical having two parallel flanges of equal length and a bottom perpendicular to said flanges in which the openings are formed.

3. A sieve for a paper pulp strainer and classifier according to claim 1, wherein said at least one element is disposed with the length thereof being at an angle in a range of 0 to 90° with the direction of the generatrices of the cylinder.

4. A sieve according to claim 3, wherein the cylinder is fastened at its lower and upper ends by a respective rim, fastened to one of the edges of a side wall.

5. A sieve according to claim 1, wherein said at least one element is juxtaposed and joined together as a cylinder by a weld which extends along the entire juxtaposition.

6. A sieve according to claim 1, wherein said at least one element is held together as a cylinder by a U-shaped section which squeezes the adjacent walls of the elements by extending over the entire juxtaposition.

7. A sieve according to claim 1, wherein said at least one element is in transverse section of the order of 10 millimeters and of a thickness of the order of one millimeter, said openings being slots of a width between about 10 microns and 1 millimeter.

8. A sieve according to claim 1, wherein between two adjacent joined side walls, a flat element , with an arcuate edge is positioned to ensure the rigidity of the cylindrical wall of said sieve.

9. S sieve according to claim 8 wherein the thickness of the flat element is close to the thickness of the U-shaped element and its width is at least equal to the height of the side walls.

10. A sieve according to claim 1, wherein said at least one element is spirally wound.

11. A sieve according to claim 10, wherein the number of spirally wound elements of U-shaped cross section is one, and further comprising means for joining and tightly clasping together the spirals of said element.

12. A sieve according to claim 1, wherein said openings include grooves and slots formed perpendicularly to the side walls in the bottom of the at least one U-shaped element, the grooves having a smaller depth than the thicknes of the bottom, the slots having a greater depth.

13. A sieve for a paper pulp strainer and classifier comprising juxtaposed elements of U-shaped cross section each having a flat bottom with openings therein and two sidewalls, and wherein the cross-section of the elements is asymmetrical, comprising two flanges of unequal length, the bottom in which the openings are formed being disposed obliquely to the flanges so that the ends of the flanges are in the same plane perpendicular to said flanges and said bottom is inclined relative to said plane, the elements of the U-shaped cross section being arranged to form a cylindrical wall provided with openings.

14. Sieve according to claim 13 characterized in that the elements comprise openings in the form of slots made in the bottom of the U, the axis of the slots forming with the plane transverse to the element an angle alpha of a value substantially equal to the angle of inclination of the spirals relative to the plane perpendicular to the longitudinal axis of the sieve.

15. A sieve for a paper pulp strainer and classifier comprising juxtaposed elements of U-shaped cross section having a flat bottom including openings therein and two sidewalls, wherein the elements of the U-shaped cross section form a cylindrical wall provided with openings, at least one said element being arched and spirally wound.

16. Sieve according to claim 15, characterized in that it is made up of a single spirally wound element of U-shaped cross section, the spirals being joined and held tightly clasped together by any means.

17. A sieve for a paper pulp strainer and classifier comprising juxtaposed elements of U-shaped cross section having a flat bottom and two sidewalls, wherein the elements of the U-shaped cross section form a cylindrical wall provided with openings, wherein said openings include grooves and slots formed in the bottoms of the U-shaped elements, perpendicularly to the side walls; the grooves having a smaller depth than the thickness of the bottom, the slots having a greater depth.

18. A sieve for a paper pulp strainer and classifier comprising:

at least one elongated element having a U-shaped cross section, said at least one U-shaped element having a bottom and two side walls, said bottom including openings, said at least one element being joined together at said side walls to form a cylinder of said at least one element, said cylinder having a cylindrical wall substantially comprising said at least one bottom including said openings, the cross section of said at least one element being asymmetrical comprising two flanges of unequal length, the bottom in which the openings are formed being disposed obliquely to the flanges so that the ends of the flanges are in the same plane perpendicular to said flanges, and said bottom is inclined relative to the cylindrical surface of the sieve.

19. A sieve according to claim 18, wherein said at least one element includes said openings in the form of slots in the bottom of the U-shaped, the axis of the slots forming with a plane transverse to the element an angle of a value substantially equal to the angle of inclination of the spirals relative to a plane perpendicular to the longitudinal axis of the sieve.

20. A sieve for a paper pulp strainer and classifier comprising:

at least one elongated element having a U-shaped cross section, said at least one U-shaped element having a bottom and two side walls, said bottom including openings, said at least one element being wound into at least one continuous loop joining together at said side walls to form a cylinder of said at least one element, said cylinder having a cylindrical wall substantially comprising said at least one bottom and including said openings, said side walls of said at least one loop extending continuously for 360 degrees, said U-shaped being unobstructed for 360 degrees of said at least one loop.

* * * * *